US009650193B2

(12) United States Patent
Miyoshi et al.

(10) Patent No.: US 9,650,193 B2
(45) Date of Patent: May 16, 2017

(54) SELF-STANDING POUCH

(71) Applicant: TOPPAN PRINTING CO., LTD., Tokyo (JP)

(72) Inventors: Seiki Miyoshi, Tokyo (JP); Motoo Yanagiuchi, Tokyo (JP); Tohru Yoshikane, Yamaguchi (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 14/901,943

(22) PCT Filed: Jul. 25, 2014

(86) PCT No.: PCT/JP2014/003946

§ 371 (c)(1),
(2) Date: Dec. 29, 2015

(87) PCT Pub. No.: WO2015/015789

PCT Pub. Date: Feb. 5, 2015

(65) Prior Publication Data

US 2016/0368681 A1 Dec. 22, 2016

(30) Foreign Application Priority Data

Jul. 29, 2013 (JP) ..... 2013-156608

(51) Int. Cl.
*B65D 30/16* (2006.01)
*B65D 75/00* (2006.01)
(Continued)

(52) U.S. Cl.
CPC ..... *B65D 75/008* (2013.01); *B65D 33/02* (2013.01); *B65D 75/5883* (2013.01)

(58) Field of Classification Search
CPC ... B65D 75/008; B65D 33/02; B65D 75/5883
(Continued)

(56) References Cited

U.S. PATENT DOCUMENTS 6,569,283 B1 5/2003 Sperry et al.
7,444,795 B2 * 11/2008 Yasuhira ..... B65B 43/465 53/133.2
(Continued)

FOREIGN PATENT DOCUMENTS

JP 2006-123931 5/2006
JP 2006123931 A * 5/2006
(Continued)

OTHER PUBLICATIONS

Machine translation of the desription of JP 2009012800 A.*
International Search Report for International Application No. PCT/JP2014/003946, mailed Sep. 22, 2014.

*Primary Examiner* — Jes F Pascua
(74) *Attorney, Agent, or Firm* — Squire Patton Boggs (US) LLP

(57) ABSTRACT

A pouch in which an air layer can be formed with a simple mechanism using a single-tube air nozzle is provided. A pouch includes, in a side edge portion where a first and a second side-surface films are sealed, a non-sealed region which is not sealed over a predetermined length, and an opening provided near an upper end of the non-sealed region penetrating through the first and/or the second side-surface films. The non-sealed region includes an air filling portion which takes therein, through the opening, air from an air blowout hole of an air nozzle having a tip surface in a predetermined distance from the opening. The air filling portion is not sealed within a predetermined radius larger than a radius of the air nozzle such that, when the air filling portion expands due to increase of internal pressure, a part near the opening is adhered to the tip surface.

6 Claims, 15 Drawing Sheets

(51) Int. Cl.
*B65D 75/58* (2006.01)
*B65D 33/02* (2006.01)

(58) Field of Classification Search
USPC ..... 383/104, 3, 7
See application file for complete search history.

(56) References Cited

U.S. PATENT DOCUMENTS

| | | | | |
|---|---|---|---|---|
| 8,051,628 | B2 * | 11/2011 | Gustafsson | B65B 61/14 53/403 |
| 2007/0089377 | A1 | 4/2007 | Yasuhira | |
| 2008/0209854 | A1 | 9/2008 | Gustafsson | |
| 2009/0282780 | A1 | 11/2009 | Gustafsson | |
| 2014/0182244 | A1 | 7/2014 | Kawamura et al. | |

FOREIGN PATENT DOCUMENTS

| | | | | |
|---|---|---|---|---|
| JP | 2007118961 | A * | 5/2007 | |
| JP | EP 1780129 | A1 * | 5/2007 | B65B 43/465 |
| JP | 2009012800 | A * | 1/2009 | |
| JP | 4771785 | | 9/2011 | |
| JP | 4846791 | | 12/2011 | |
| JP | 5104073 | | 12/2012 | |
| JP | 2014-139090 | | 7/2014 | |

* cited by examiner

SELF-STANDING POUCH

TECHNICAL FIELD

The present invention relates to a self-standing pouch.

BACKGROUND ART

As a package for packaging contents such as liquid, a viscous substance, powder, a solid, or the like, a package formed by joining films together and sealing peripheral portions of the films has been known.

FIG. 10 is a plan view of a self-standing pouch 900 disclosed in Patent Literature 1. The pouch 900 is produced by inserting a bottom film 903 folded in half, from a fold line side, between a first side-surface film 901 and a second side-surface film 902, and sealing peripheral portions of the films joined together. Further, a spout 904 for taking out contents is attached so as to be sandwiched and sealed between the first side-surface film 901 and the second side-surface film 902. A region excluding the peripheral portions of the films forms a storage part 905 in which the contents are stored. Inside the region where the films are sealed, a non-sealed region 906 is provided over a predetermined length in a height direction. At an upper end of the non-sealed region 906, an air filling portion 908 is formed penetrating through the first side-surface film 901 and/or the second side-surface film, and air is injected into the non-sealed region 906 through the air filling portion 908, thereby forming an air layer 907. By unfolding the bottom film 903 so that the first side-surface film 901 and the second side-surface film 902 form a cylindrical shape at a bottom portion of the pouch 900, the pouch 900 is allowed to stand by itself.

The air layer 907 makes the first side-surface film 901 and the second side-surface film 902 less likely to bend at the air layer 907 and its vicinity. Therefore, when the pouch 900 is made to stand by itself, the overall shape of the pouch 900 is less likely to deform, and thus the self-standing property of the pouch 900 is easily maintained. When the pouch 900 is carried or when the contents are taken out, the air layer 907 serve as a handle. Therefore, a user can easily hold the pouch 900 by grasping the air layer 907.

FIG. 11 is a schematic diagram showing an example of a method for injecting air into the non-sealed region 906. Arrows shown in FIG. 11 indicate the flow of air. Injection of air into the non-sealed region 906 is performed as follows. That is, with an air nozzle 909 being applied to one of the side-surface films and a receiving member 911 for the air nozzle 909 being applied to the other side-surface film, air is blown from an air blowout hole 910 of the air nozzle 909 and injected into the non-sealed region 906 through the air filling portion 908.

CITATION LIST

Patent Literature

[Patent Literature 1] Japanese Laid-Open Patent Publication No. 2006-123931

SUMMARY OF THE INVENTION

Problems to be Solved by the Invention

When air is injected into the non-sealed region 906, since the air nozzle 909 is closely attached to the first side-surface film 901 and/or the second side-surface film in which the air filling portion 908 is formed, an air flow path in the non-sealed region 906 is narrowed by a tip of the air nozzle 909, and consequently, a satisfactory air injection result cannot be obtained.

As a method for injecting air into the non-sealed region 906 while securing an air flow path in the non-sealed region 906, a method of using an air nozzle 909 having a partially chamfered tip portion as shown in FIG. 12, and a method of using a partially recessed receiving member 911 as shown in FIG. 13, are conceivable. In FIGS. 12 and 13, arrows indicate the flow of air. However, when the air nozzle 909 having the partially chamfered tip portion is used, a gap is formed between the chamfered portion and the first side-surface film 901, and leakage of air occurs as shown by a broken arrow in FIG. 12. When the partially recessed receiving member 911 is used, the first side-surface film 901 and the second side-surface film 902 escape in the recess, and a gap is formed between the air nozzle 909 and the first side-surface film 901, resulting in leakage of air as shown by a broken allow in FIG. 13. Such leakage of air causes problems such as an increase in the amount of air to be injected into the non-sealed region 906, an increase in the time required for the air injection, and variation in the pressure of the air injected into the non-sealed region 906.

Further, there is a method of using a dual-tube air nozzle 909 including an air blowout hole 910 and a suction hole 912 as shown in FIG. 14. In FIG. 14, arrows indicate the flow of air. In this method, a side-surface film on which the air nozzle 909 is applied is attracted to the air nozzle 909 by sucking air through the suction hole 912, and air is injected through the air blowout hole 910. In this method, the pouch 900 in which the air filling portions 908 are formed in both the first side-surface film 901 and the second side-surface film 902 cannot be used. The pouch 900 in which the air filling portion 908 is formed in only one of the first side-surface film 901 and the second side-surface film 902 needs a process of forming the air filling portion 908, separately from the process of punching over the entire periphery into the shape of the pouch 900, which makes the pouch manufacturing process complicated. Further, since the dual-tube air nozzle 909 is complicated in structure, the cost thereof is high, and the time required for enclosing air is increased.

Therefore, an object of the present invention is to provide a pouch which allows formation of an air layer by sealing air with a simple mechanism using a single-tube air nozzle.

Solution to the Problems

The present invention is a self-standing pouch in which a first side-surface film, a second side-surface film, and a bottom film sandwiched therebetween are joined together, peripheral portions thereof are sealed to form a storage part, and the bottom film serves as a lower bottom surface of the storage part. The pouch includes, in a side edge portion corresponding to a region where peripheral portions at side ends of the first side-surface film and the second side-surface film are sealed, a non-sealed region which is a region not sealed over a predetermined length in a top-bottom direction, and an opening provided near an upper end of the non-sealed region, penetrating through at least one of the first side-surface film and the second side-surface film. The non-sealed region includes an air filling portion which takes therein, through the opening, air blown out from an air blowout hole of an air nozzle having a tip surface disposed at a position a predetermined distance apart from the opening. The air filling portion is not sealed within a predetermined radius larger than a radius of the air nozzle from a center of the opening such that, when the air filling portion expands due to an increase in an internal pressure, a part near the opening is closely adhered to the tip surface of the air nozzle.

Advantageous Effects of the Invention

According to the present invention, it is possible to provide a pouch in which air can be injected with a simple mechanism using a single-tube air nozzle.

EMBODIMENTS FOR CARRYING OUT THE INVENTION

First Embodiment

Figure 1:
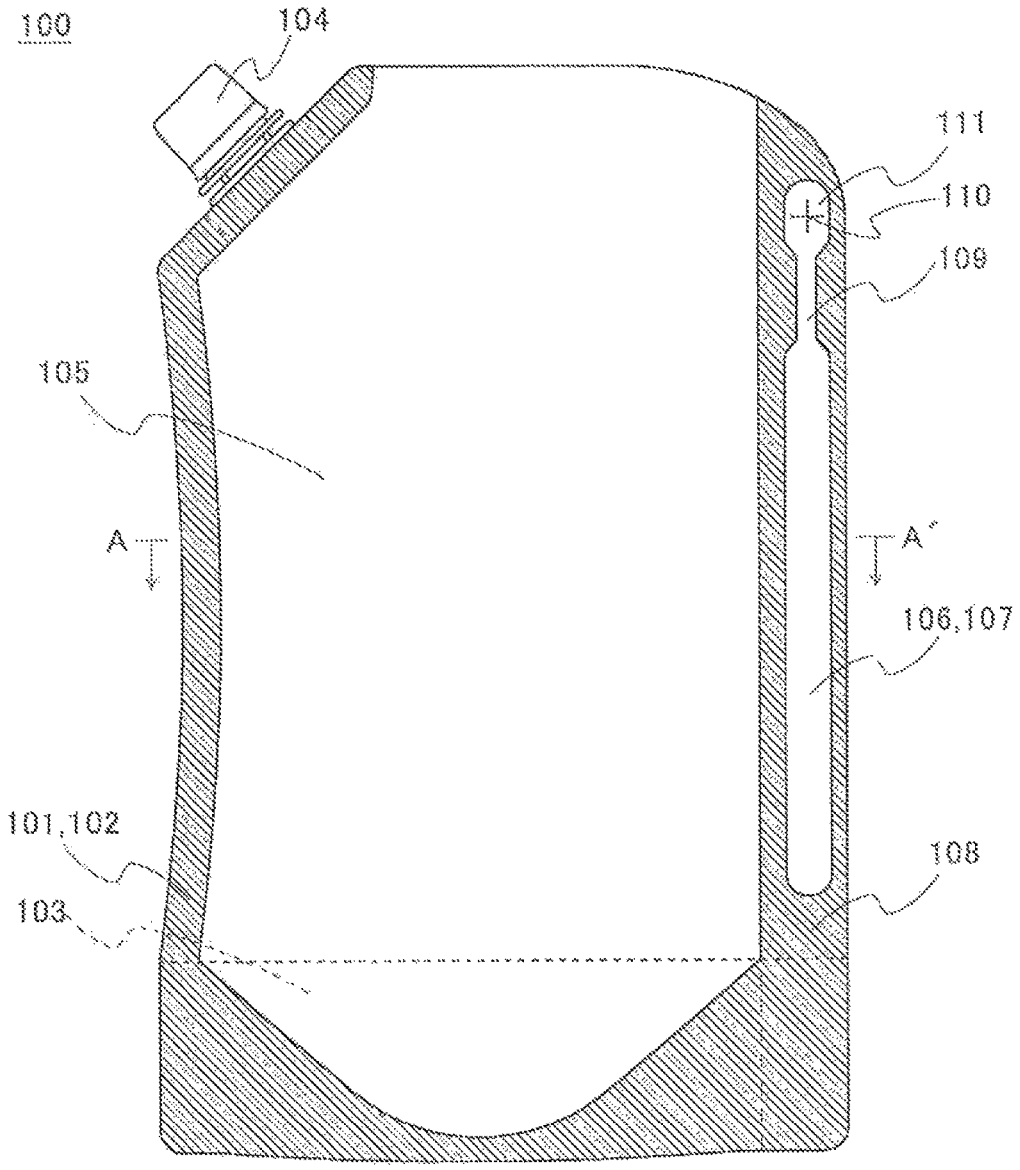
FIG. 1 is a plan view of a pouch according to a first embodiment of the present invention.
Figure 2:
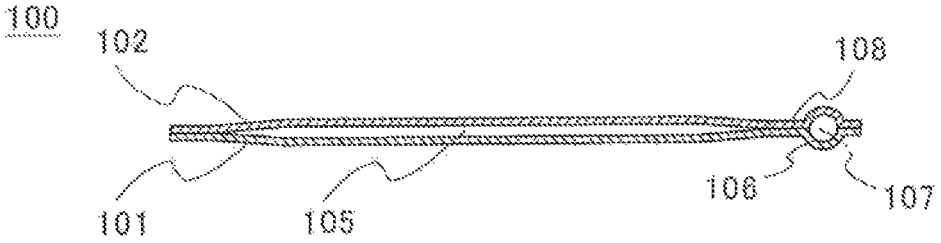
FIG. 2 is a cross-sectional view of the pouch taken along a line A-A' in FIG. 1.

FIG. 1 is a plan view showing a pouch 100 according to the present embodiment. FIG. 2 is a cross-sectional view of the pouch 100 taken along a line A-A' in FIG. 1. The pouch 100 is formed by joining a first side-surface film 101, a second side-surface film 102, and a bottom film 103 together. The bottom film 103 is folded in half and inserted between the films 101 and 102. Peripheral portions of these films joined together are sealed, thereby forming a storage part 105. When the bottom film 103 is unfolded so that the first side-surface film 101 and the second side-surface film 102 form a cylindrical shape at a bottom portion on the side where the bottom film 103 is sealed, the pouch 100 is allowed to stand by itself with the bottom film 103 being a bottom surface.

Regarding the self-standing pouch 100, the vertical direction is referred to as a top-bottom direction, and the horizontal direction is referred to as a right-left direction. In a region where the peripheral portions of the first side-surface film 101 and the second side-surface film 102 are sealed, a non-sealed region 106 which is a region not sealed over a predetermined length in the top-bottom direction is formed in a side edge portion 108 which is an end portion in the left-right direction. Air is injected into the non-sealed region 106 to form an air layer 107, and the first side-surface film 101 and the second side-surface film 102 expand to form a cylindrical shape in the non-sealed region 106 as shown in FIG. 2. A spout 104 for taking out contents is sandwiched between the first side-surface film 101 and the second side-surface film 102 and sealed. The spout 104 may be dispensed with.

In the pouch 100, the air layer 107 makes the first side-surface film 101 and the second side-surface film 102 less likely to bent at the air layer 107 and its vicinity. Therefore, when the pouch 100 is made to stand by itself, the overall shape of the pouch 100 is less likely to deform, and thus the self-standing property of the pouch 100 is easily maintained. When the pouch 100 is carried or when the contents are taken out, the first side-surface film 101 and the second side-surface film 102 around the air layer 107 serve as a handle. Therefore, a user can easily hold the pouch 100 by grasping this portion. The pouch 100 is less likely to deform in shape, and can be stably held. Therefore, even if the amount of the contents is small, the position of an outlet port can be made stable when the contents are taken out, and the contents can be moved to an intended position.

Figure 3:
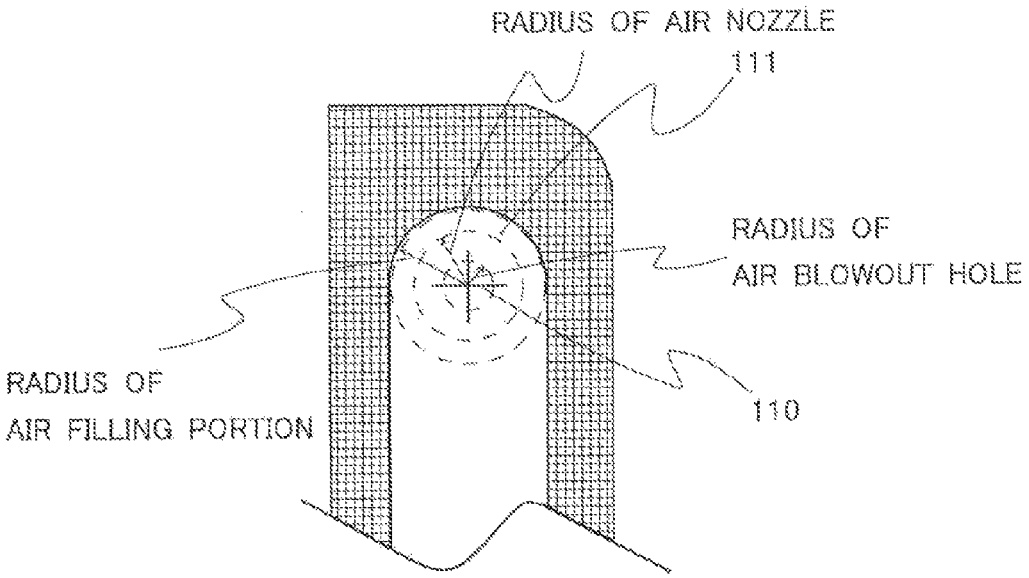
FIG. 3 is a partial enlarged view showing an air filling portion according to the first embodiment of the present invention.

FIG. 3 shows an air filling portion 111. The shape of the air filling portion 111 is described with reference to FIG. 3. The pouch 100 has the air filling portion 111 through which air is injected into the non-sealed region 106. The air filling portion 111 has an opening 110 which is a cross-shaped slit penetrating through at least one of the first side-surface film 101 and second side-surface film 102. The air filling portion 111 is provided near an upper end of the non-sealed region 106. The opening 110 is composed of two slits which penetrate through at least one of the first side-surface film 101 and the second side-surface film 102 so as to extend in the right-left direction and the top-bottom direction, and intersect with each other. However, in the process of using a machine for manufacturing the pouch 100, in order to form the opening 110 in the same punching work as punching for entire-periphery trimming of the pouch 100, it is preferable that the opening 110 is formed penetrating through both the first side-surface film 101 and the second side-surface film 102. In the present embodiment, as an example, the opening 110 is formed in both the first side-surface film 101 and the second side-surface film 102.

Further, the air filling portion 111 is not sealed in a predetermined radius larger than the radius of an air nozzle centering on the opening 110. With the air filling portion having the above-mentioned shape, when air is injected into the air filling portion 111 from the air nozzle having the tip surface located at a position apart from the air filling portion 111 by a predetermined distance, the internal pressure of the air filling portion 111 increases and thereby the air filling portion 111 expands like a balloon. At this time, a part near the opening 110 is closely adhered to the air nozzle over the circumference of the air blowout hole at the tip surface of the air nozzle. The predetermined radius range mentioned above may be appropriately set according to the distance between the air nozzle and the opening 110 and/or the diameter of the air blowout hole of the air nozzle, in order achieve close adhesion of the tip surface of the air nozzle and the part near the opening 110.

The length of the slits of the opening 110 may be set in a range longer than the diameter of the air blowout hole of the air nozzle so that the opening 110 is sufficiently opened when the air filling portion 111 expands like a balloon, and shorter than the diameter of the air nozzle so that leakage of air from a gap between the tip surface of the air nozzle and the opening 110 is suppressed.

Further, the pouch 100 has a constricted portion 109 extending in the top-down direction over a predetermined range, at a lower end side of the air filling portion 111. The length of the constricted portion 109 in the right-left direction is desired to be as short as possible in a range that ensures a sufficient flow rate of air flowing into the non-sealed region 106.

Figure 4:
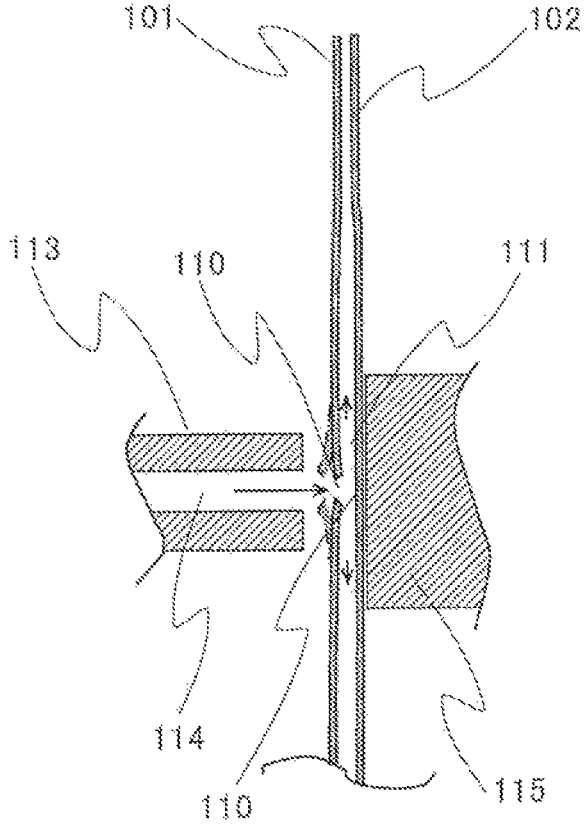
FIG. 4 is a diagram showing an air injection method for the pouch according to the first embodiment of the present invention.
Figure 5:
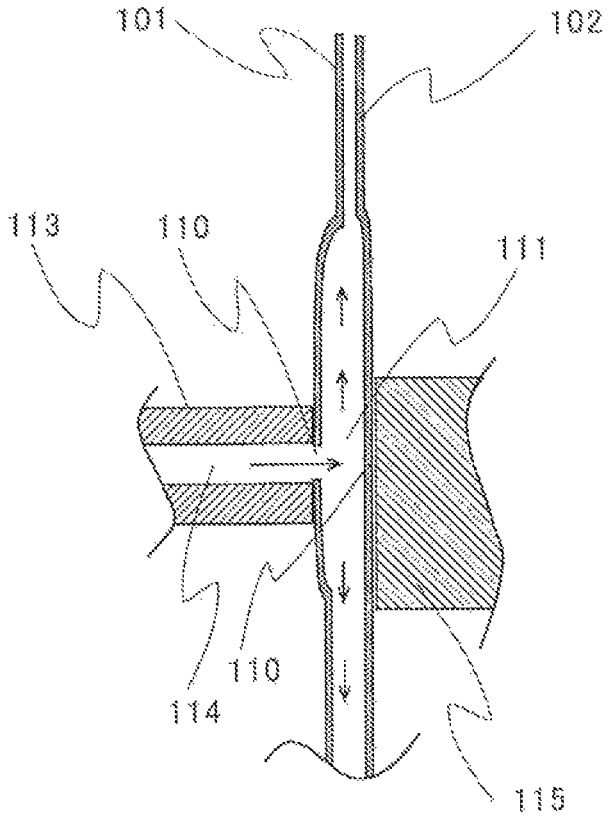
FIG. 5 is a diagram showing an air injection method for the pouch according to the first embodiment of the present invention.

The pouch 100 is manufactured as follows. That is, the bottom film 103 folded in half is inserted between the first side-surface film 101 and the second side-surface film 102 from the fold line side. First, the bottom-side peripheral portions of the films and the both side edge portions thereof are sealed so as to form the non-sealed region 106. Then, the pouch 100 is subjected to entire-periphery trimming by punching, and simultaneously with the punching, the opening 110 is formed penetrating through the first side-surface film 101 and the second side-surface film 102. Thereafter, air is injected into the air filling portion 111 to form the air layer 107 in the non-sealed region 106. The procedure of injecting air into the air filling portion 111 is described with reference to FIG. 4 and FIG. 5. In FIG. 4 and FIG. 5, arrows indicate the flow of air. As shown in FIG. 4, for example, an air nozzle 113 is located at a position where the tip surface of the air nozzle 113 is apart from the opening 110 formed in the first side-surface film 101 by a predetermined distance, and a receiving member 115 for the air nozzle 113 is applied to the second side-surface film 102. Thereafter, air is blown from the air blowout hole 114 at the center of the tip surface of the air nozzle 113 which is an annular flat surface. At this time, the part near the opening 110 is vibrated due to the air blow, and starts to take the air into the air filling portion 111 through the opening 110. Thereafter, as shown in FIG. 5, as the air is being taken into the air filling portion 111, the internal pressure of the air filling portion 111 increases, and the air filling portion 111 expands like a balloon, whereby the part near the opening 110 is closely adhered to the circumference of the air blowout hole 114 at the tip surface of the air nozzle 113. When the part near the opening 110 is closely adhered to the circumference of the air blowout hole 114 at the tip surface of the air nozzle 113, the air blowout hole 114 and the non-sealed region 106 become a closed space, thereby preventing leakage of air from a space between the air nozzle 113 and the air filling portion 111, and realizing injection of air into the non-sealed region 106 without causing the air flow path inside the air filling portion 111 to be narrowed. The larger the distance between the air nozzle 113 and the opening 110 is within a predetermine range, the wider the air flow path inside the air filling portion 111 can be secured, and therefore, air can be injected into the non-sealed region 106 in a shorter time. Further, when the air filling portion 111 has the above-mentioned shape, air can be satisfactorily injected into the air filling portion 111 regardless of the material of the pouch 100. For example, even when the pouch 100 is made of a material having poor elasticity, the air filling portion 111 can be sufficiently expended, and air can be satisfactorily injected into the non-sealed region 106. Therefore, a material having less elasticity can be preferably used as a material of the pouch 100.

Further, the larger the diameter of the air blowout hole 114 of the air nozzle 113 is, the more a positional error of the air nozzle 113 with respect to the opening 110 can be absorbed, and thereby the rate of occurrence of defectives when air is injected into the air filling portion 111 can be reduced. Also in this case, it is preferable to increase the radius range of the air filling portion 111 so that the air filling portion 111 sufficiently expands also at a position opposing the tip surface of the air nozzle 113.

Further, at the time when the internal pressure of the air filling portion 111 increases to a predetermined level, filling of air is stopped. If the air pressure does not reach the predetermined level, it is determined that a defect, such as a large error of the position of the opening 110 with respect to the air nozzle 113, occurs.

Figure 6:
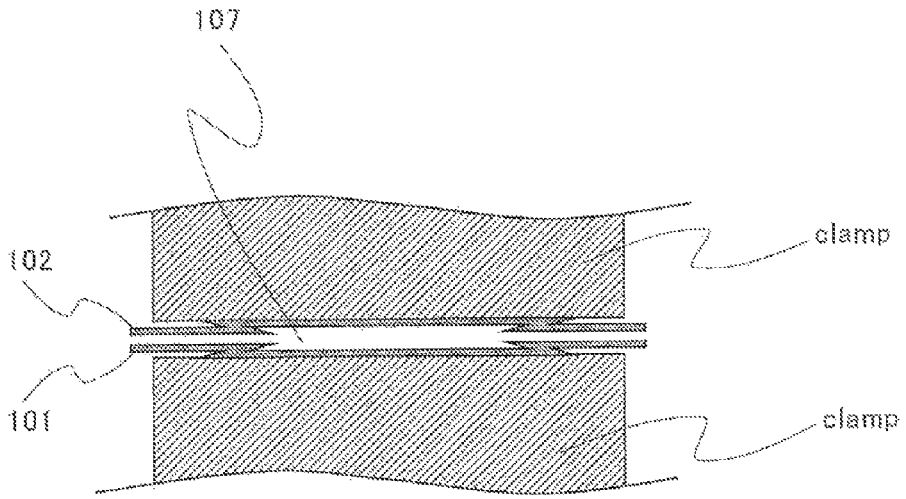
FIG. 6 is a cross-sectional view of the pouch with an air layer being clamped, according to the first embodiment of the present invention.

Next, after formation of the air layer 107 in the non-sealed region 106, in order to prevent leakage of air from the air layer 107, the constricted portion 109 is pinched with a clamp in the state where the internal pressure is being applied to the air layer 107, thereby to block the air flow path. When the internal pressure is being applied due to the air, the cross-sectional shape of the air layer 107 taken in the right-left direction is almost complete round as shown in FIG. 2. In addition, when the air flow path expands sterically, the sealed portions at the peripheral portions of the air flow path get closer to each other than before the expanding of the air flow path. FIG. 6 shows a cross section of the air layer 107 being pinched with the clamp to block the air flow path. As shown in FIG. 6, since the air layer 107 is pinched with the clamp in the state where the films are folded at the both ends and thereby a space is formed, the air flow path cannot be sufficiently blocked. On the other hand, the constricted portion 109 that narrows the air flow path between the air filling portion 111 and the air layer 107 has, at its both ends, the air filling portion 111 and the air layer 107 each expanding in a dome shape, whereby the cross-sectional shape of the constricted portion 109 taken along the right-left direction is deformed as compared to a complete round. Therefore, by pinching the constricted portion 109 with the clamp, the air flow path can be preferably blocked without the films being folded at the both ends. Even when the cross-sectional shape of the constricted portion 109 taken along the right-left direction is an almost complete round, since the diameter of the constricted portion 109 is small, the films are not likely to be folded at the both ends. Further, instead of providing the constricted portion 109, the side edge portions of the air layer 107 may be partially pinched with a gripper holding the pouch 100 to narrow the air flow path.

Next, the pouch 100 is transferred to a machine for subjecting the air filling portion 111 to a sealing process, with the constricted portion 109 being pinched with the clamp in order to block the air flow path, and then the air filling portion 111 is sealed. In the pouch 100, since the air filling portion 111, the constricted portion, and the air layer 107 are arranged so as to be substantially aligned in the top-bottom direction, the constricted portion 109 can be pinched with the clamp in the right-left direction with respect to the pouch 100. Therefore, in the sealing process for the air filling portion 111, interference between the clamp and a heat source located above the clamp can be easily avoided.

Figure 7A:
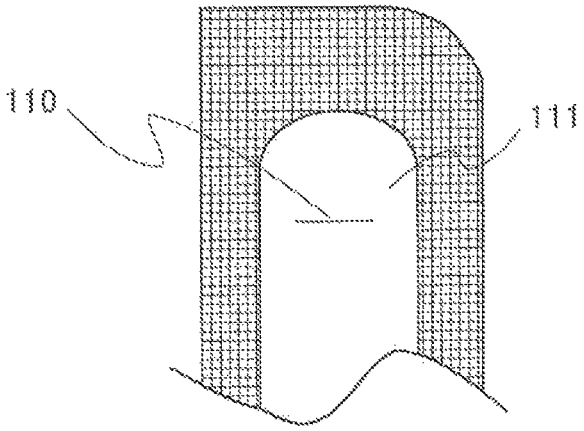
FIG. 7A is a diagram showing another shape of an opening portion of the pouch according to the first embodiment of the present invention.
Figure 7B:
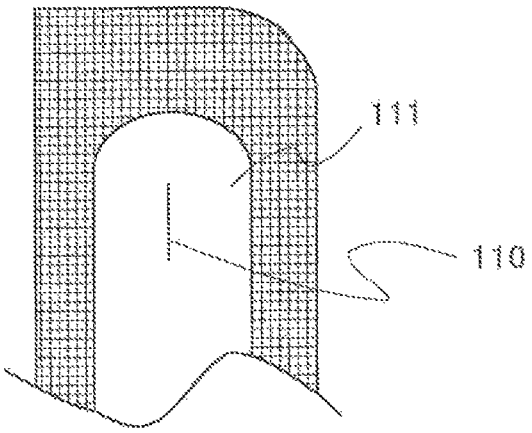
FIG. 7B is a diagram showing another shape of an opening portion of the pouch according to the first embodiment of the present invention.
Figure 7C:
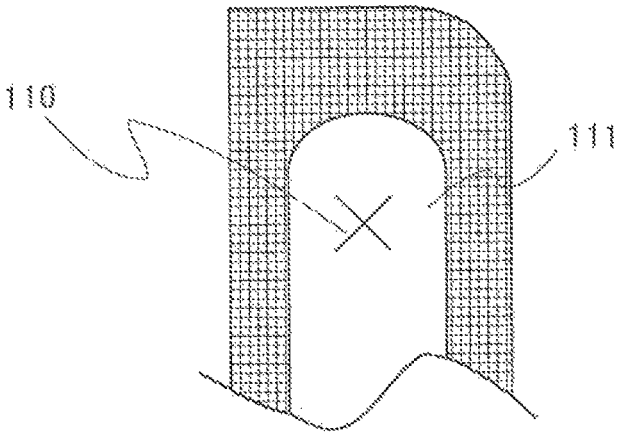
FIG. 7C is a diagram showing another shape of an opening portion of the pouch according to the first embodiment of the present invention.
Figure 7D:
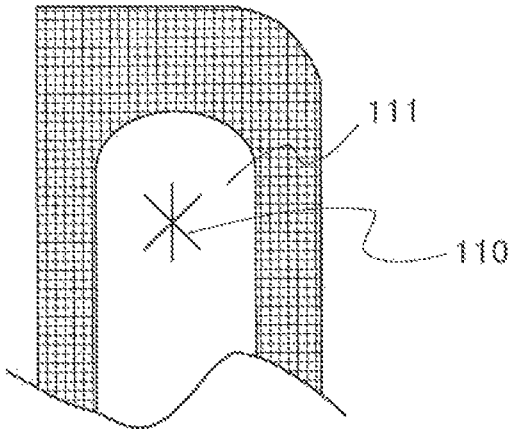
FIG. 7D is a diagram showing another shape of an opening portion of the pouch according to the first embodiment of the present invention.
Figure 7E:
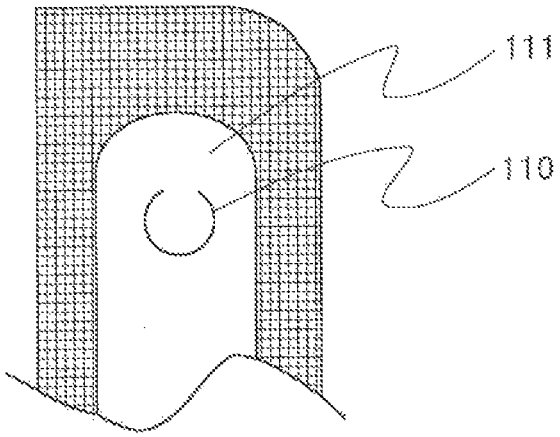
FIG. 7E is a diagram showing another shape of an opening portion of the pouch according to the first embodiment of the present invention.
Figure 7F:
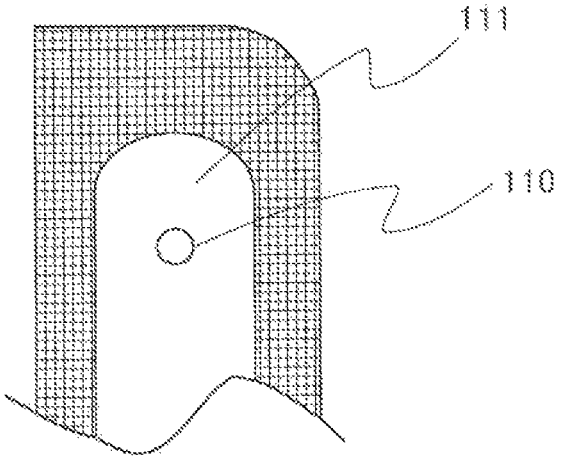
FIG. 7F is a diagram showing another shape of an opening portion of the pouch according to the first embodiment of the present invention.

In the above-mentioned embodiment, the opening 110 is a cross-shaped slit. However, the present invention is not limited thereto. Examples of the slit of the opening 110 may include: a single straight-line slit extending in the right-left direction as shown in FIG. 7A; a single straight-line slit extending in the top-bottom direction as shown in FIG. 7B; two straight-line slits extending in an upper right direction and an upper left direction as shown in FIG. 7C; three straight-line slits intersecting each other as shown in FIG. 7D; and an arc-shaped slit as shown in FIG. 7E. The opening 110 is not necessarily a slit but may be a hollow round hole as shown in FIG. 7F.

Figure 8A:
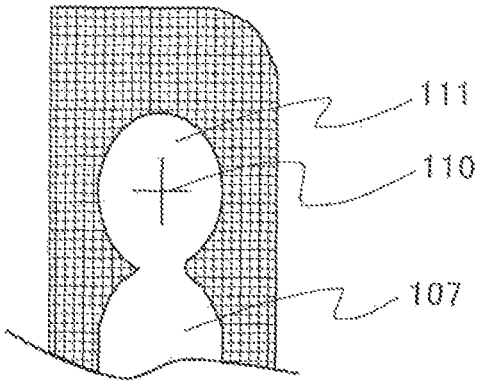
FIG. 8A is a diagram showing another shape of a constricted portion of the pouch according to the first embodiment of the present invention.
Figure 8B:
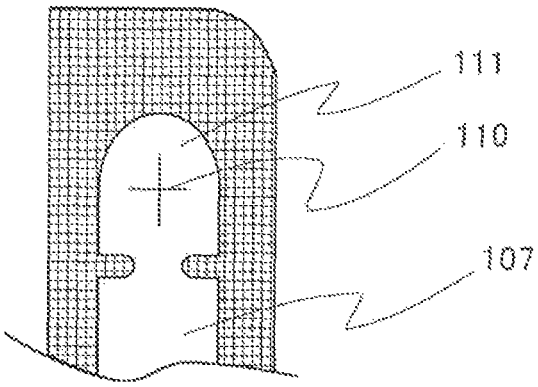
FIG. 8B is a diagram showing another shape of the constricted portion of the pouch according to the first embodiment of the present invention.
Figure 8C:
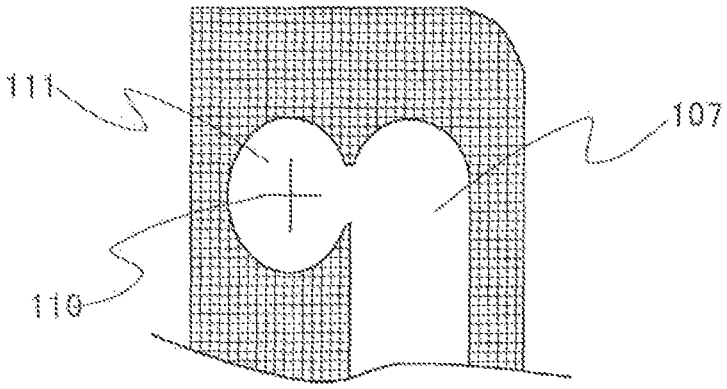
FIG. 8C is a diagram showing another shape of the constricted portion of the pouch according to the first embodiment of the present invention.

In the above-mentioned embodiment, the constricted portion 109 extends in the top-bottom direction over a predetermined region. However, as shown in FIGS. 8A and 8B, a predetermined portion between the air filling portion 111 and the air layer 107 may be constricted. The length of the constricted predetermined portion in the right-left direction is also desired to be as short as possible in a range that ensures a sufficient flow rate of air flowing into the non-sealed region 106. Further, in the above-mentioned embodiment, the air filling portion 111 and the air layer 107 are connected to each other in the top-bottom direction. However, as shown in FIG. 8C, the air filling portion 111 and the air layer may be connected to each other in the right-left direction, and a predetermined portion between the air filling portion 111 and the air layer 107 may be constricted. Further, when the air filling portion 111 and the air layer are connected to each other in the right-left direction as shown in FIG. 8C, the constricted predetermined portion can be pinched with a clamp in the top-bottom direction with respect to the pouch 100. Therefore, interference between the clamp and a heat source located to the left of the clamp can be easily avoided.

Figure 9:
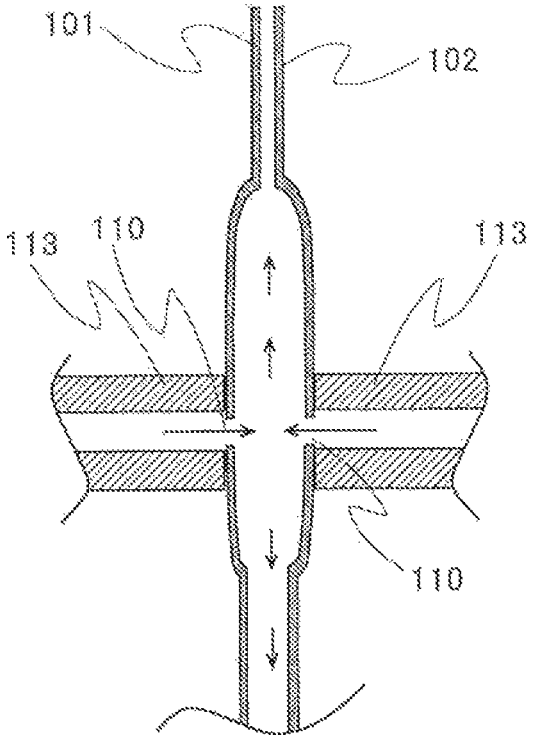
FIG. 9 is a diagram showing another example of the air injection method for the pouch according to the first embodiment of the present invention.
Figure 10:
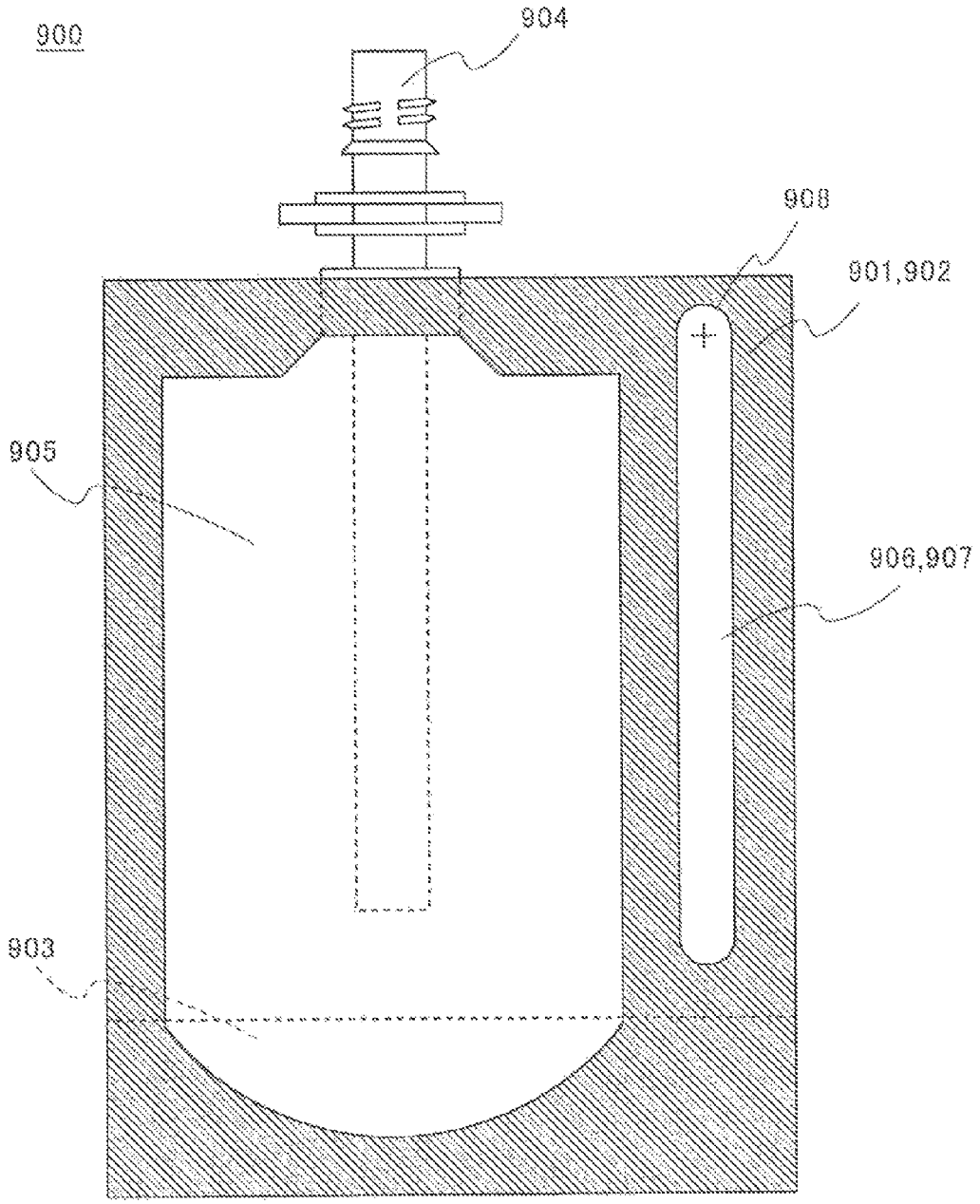
FIG. 10 (PRIOR ART)
FIG. 10 is a plan view of a conventional pouch.
Figure 11:
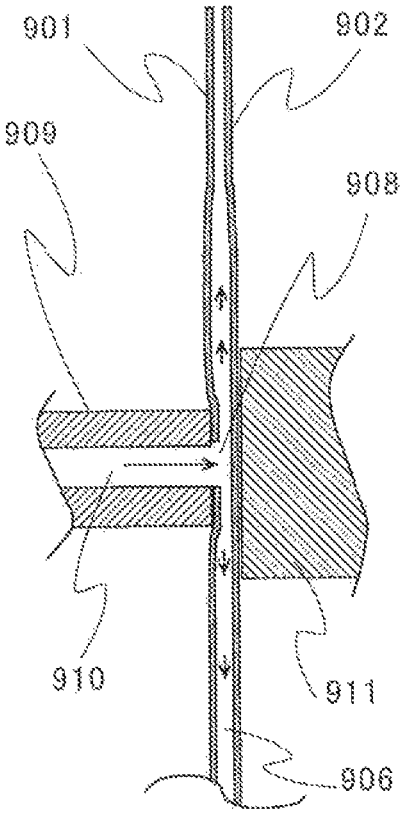
FIG. 11 (PRIOR ART)
FIG. 11 is a diagram showing an air injection method for the conventional pouch.
Figure 12:
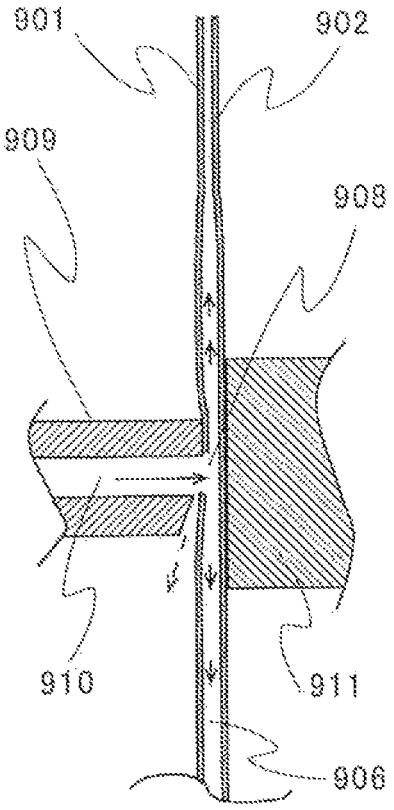
FIG. 12 (PRIOR ART)
FIG. 12 is a diagram showing another example of the air injection method for the conventional pouch.
Figure 13:
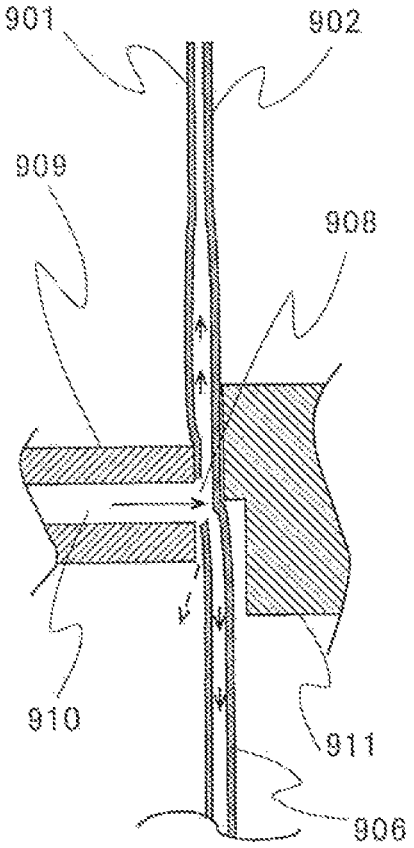
FIG. 13 (PRIOR ART)
FIG. 13 is a diagram showing another example of the air injection method for the conventional pouch.
Figure 14:
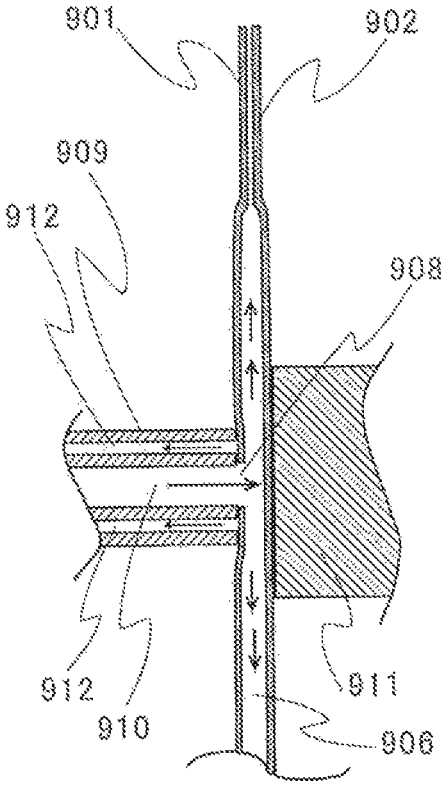
FIG. 14 (PRIOR ART)
FIG. 14 is a diagram showing another example of the air injection method for the conventional pouch.

Further, the air injection method has been described in which the air nozzle 113 is disposed only on the opening 110 side which is formed in the first side-surface film 101 or the second side-surface film 102. However, when the air filling portion 111 is provided in both the first side-surface film 101 and the second side-surface film 102, as shown in FIG. 9, an air nozzle 113, instead of the receiving member 115, may be disposed at a position a predetermined distance apart from the opening 110 formed in the second side-surface film 102, and then air may be injected into the openings 110 provided in both the first side-surface film 101 and the second side-surface film 102.

INDUSTRIAL APPLICABILITY

The present invention is useful for self-standing pouches and the like. In particular, the present invention is useful to improve air injection efficiency, working efficiency in a pouch manufacturing process, and the like.

DESCRIPTION OF THE REFERENCE CHARACTERS

100 pouch
101 first side-surface film
102 second side-surface film
103 bottom film
104 spout
105 storage part
106 non-sealed region
107 air layer
108 side edge portion
109 constricted portion
110 opening
111 air filling portion
113 air nozzle
114 air blowout hole
115 receiving member
900 pouch
901 first side-surface film
902 second side-surface film
903 bottom film
904 spout
905 storage part
906 non-sealed region
907 air layer
908 air filling portion
909 air nozzle
910 air blowout hole
911 receiving member
912 suction hole

The invention claimed is:

1. A self-standing pouch in which a first side-surface film, a second side-surface film, and a bottom film sandwiched therebetween are joined together, peripheral portions thereof are sealed to form a storage part, and the bottom film serves as a lower bottom surface of the storage part, the self-standing pouch comprising:

a non-sealed region provided in a side edge portion corresponding to a region where peripheral portions at side ends of the first side-surface film and the second side-surface film are sealed, the non-sealed region being a region not sealed over a predetermined length in a top-bottom direction, and an opening provided at a position near an upper end of the non-sealed region, the opening being formed penetrating through at least one of the first side-surface film and the second side-surface film, wherein the non-sealed region includes an air filling portion which takes therein, through the opening, air blown out from an air blowout hole of an air nozzle having a tip surface disposed at a position a predetermined distance apart from the opening, and the air filling portion is not sealed within a predetermined radius larger than a radius of the air nozzle from a center of the opening such that, when the air filling portion expands due to an increase in an internal pressure, a part near the opening is closely adhered to the tip surface of the air nozzle, and the opening includes a slit having a length longer than a diameter of the air blowout hole of the air nozzle and shorter than a diameter of the air nozzle.

2. The self-standing pouch according to claim 1, wherein the slit penetrates through the first side-surface film and/or the second side-surface film.

3. The self-standing pouch according to claim 1, wherein the slit has a straight-line shape.

4. The self-standing pouch according to claim 1, wherein the opening is a plurality of straight-line slits each having a length longer than a diameter of the air blowout hole of the air nozzle and shorter than a diameter of the air nozzle, and the plurality of slits intersect with each other.

5. A self-standing pouch in which a first side-surface film, a second side-surface film, and a bottom film sandwiched therebetween are joined together, peripheral portions thereof are sealed to form a storage part, and the bottom film serves as a lower bottom surface of the storage part, the self-standing pouch comprising:

a non-sealed region provided in a side edge portion corresponding to a region where peripheral portions at side ends of the first side-surface film and the second side-surface film are sealed, the non-sealed region being a region not sealed over a predetermined length in a top-bottom direction, and an opening provided at a position near an upper end of the non-sealed region, the opening being formed penetrating through at least one of the first side-surface film and the second side-surface film, wherein the non-sealed region includes an air filling portion which takes therein, through the opening, air blown out from an air blowout hole of an air nozzle having a tip surface disposed at a position a predetermined distance apart from the opening, and the air filling portion is not sealed within a predetermined radius larger than a radius of the air nozzle from a center of the opening such that, when the air filling portion expands due to an increase in an internal pressure, a part near the opening is closely adhered to the tip surface of the air nozzle, and the opening is an arc-shaped slit or a hole having a diameter larger than a diameter of the air blowout hole of the air nozzle and smaller than a diameter of the air nozzle.

6. The self-standing pouch according to claim 1, wherein the non-sealed region further includes a constricted portion near a location below the air filling portion, the constricted portion having a length, in a right-left direction, shorter than other portions.

* * * * *